US005560417A

United States Patent [19]

Smiley

[11] Patent Number: 5,560,417

[45] Date of Patent: Oct. 1, 1996

[54] DRAPERY TRAVERSE ROD MASTER CARRIER

[75] Inventor: Charles F. Smiley, Waunakee, Wis.

[73] Assignee: Springs Window Fashions Division, Inc., Middleton, Wis.

[21] Appl. No.: 439,037

[22] Filed: May 11, 1995

[51] Int. Cl.[6] ..... A47H 1/00; A47H 5/00; E06B 9/56; E05D 15/06

[52] U.S. Cl. ..... 160/341; 160/330; 160/340; 160/345; 16/95 R; 16/95 D; 16/96 D

[58] Field of Search ..... 160/341, 345, 160/344, 330, 332, 340, 370; 16/95 R, 95 D, 96 D

[56] References Cited

U.S. PATENT DOCUMENTS

| | | | |
|---|---|---|---|
| 3,482,618 | 12/1969 | Johnson et al. | 160/345 |
| 3,663,988 | 5/1972 | Malies | 160/87.2 |
| 3,736,620 | 6/1973 | Williamson | 16/96 D X |
| 3,946,791 | 3/1976 | Brown | 160/345 |
| 4,495,671 | 1/1985 | Comeau et al. | 16/95 D X |
| 4,733,435 | 3/1988 | Darner | 160/345 X |
| 5,170,531 | 12/1992 | Ryan | 160/341 X |

*Primary Examiner*—Blair Johnson
*Assistant Examiner*—Bruce A. Lev
*Attorney, Agent, or Firm*—Vernon J. Pillote

[57] ABSTRACT

A two-piece drapery traverse rod master carrier comprising a carrier body having rod guides for supporting the carrier body for movement along a traverse rod, and a drapery support arm having lead and trail ends and a mounting stem extending laterally from one side of the support arm at a location intermediate the lead and trail ends of the arm. The carrier body has an arm guide supporting the mounting stem for horizontal movement in a direction perpendicular to the path of movement of the carrier body when the lead end of the drapery support arm extends from the arm guide to adjust the lateral position of the support arm relative to the slide body. The drapery support arm can be positioned on the carrier body with the lead end extending in either of two opposed directions generally parallel to the path of movement of the carrier body.

14 Claims, 3 Drawing Sheets

FIG. 1
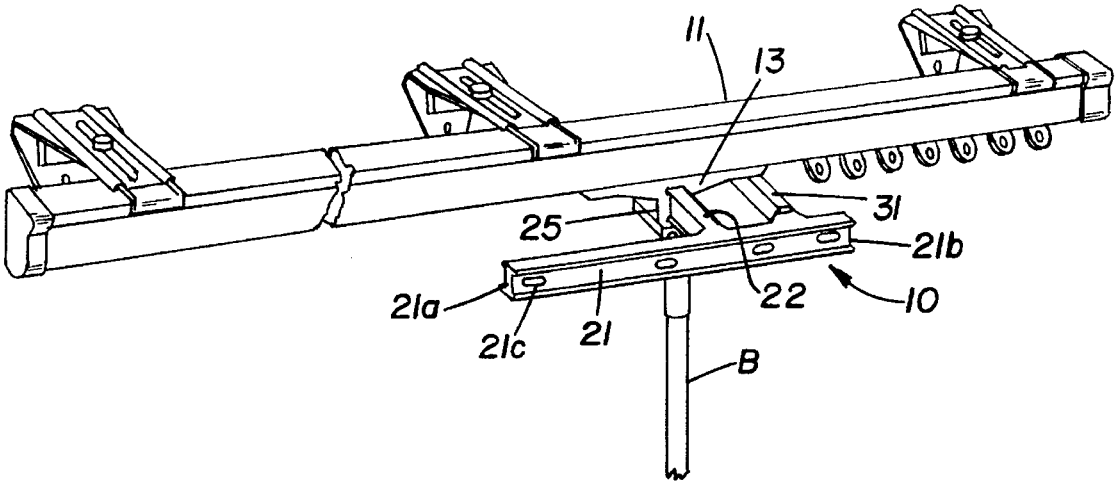
FIG. 2
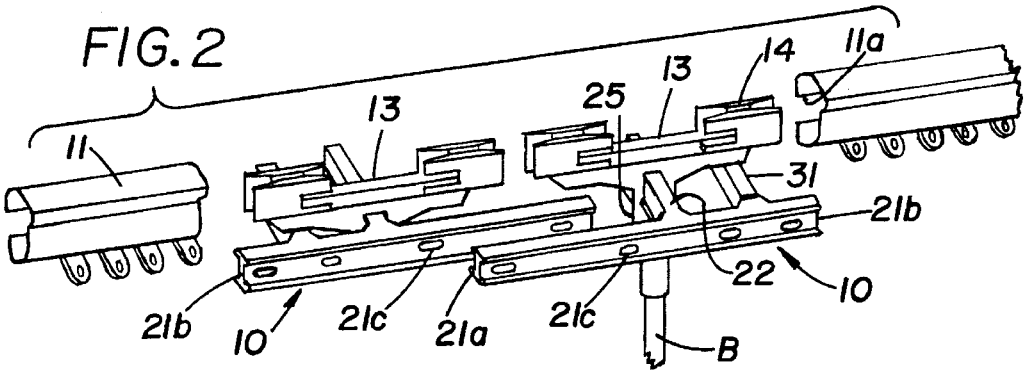
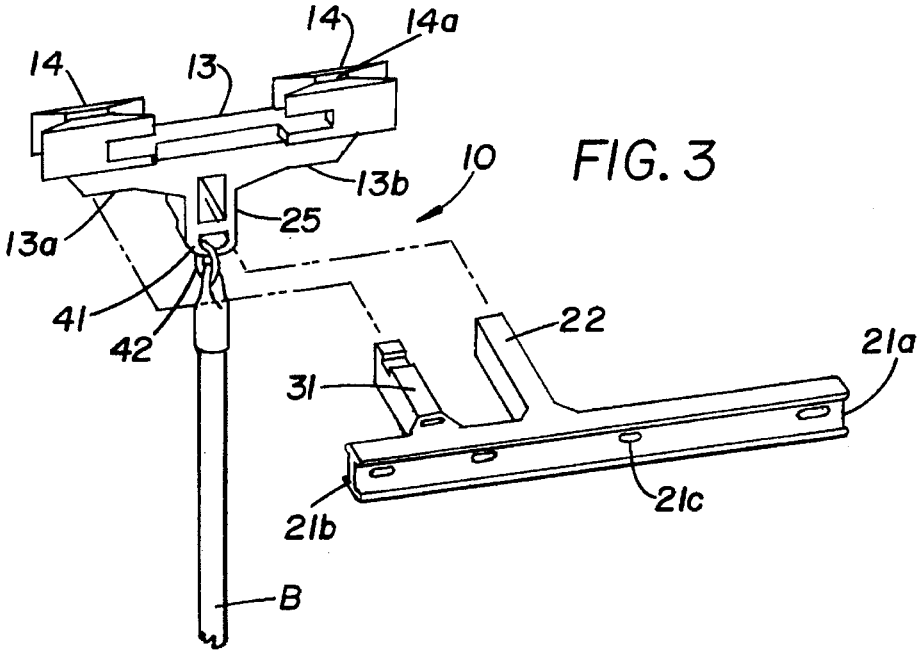
FIG. 3

DRAPERY TRAVERSE ROD MASTER CARRIER

BACKGROUND OF THE INVENTION

In traverse rod installations that use traverse cords in the rod to move the drapery rod master carrier or carriers along the rod, the cords are commonly connected to the master carrier at locations substantially aligned with the guides that support the master carriers on the rod, so that the forces applied by the traverse cords to the master carriers substantially parallel the path of movement of the master carriers along the rod. While traverse cords provide relatively smooth operation of the master carriers along the rod, there are some objections to the use of traverse cords not only because of increased costs in manufacture and assembly, but also due to the depending operating portions of the traverse cords which can sometimes extend into the floor or, if connected together, form a depending loop that constitutes a potential safety hazard for children.

Drapery rods have also been made for example as disclosed in U.S. Pat. Nos. 3,743,002; 3,983,921 and 5,170,531, which use batons for traversing the master carrier along the rod. However, when the baton is attached to the master carrier at a location laterally offset a substantial distance from the trackway in the rod, such as on the drapery support arm or on an arm that extends over the top of the drapery to the front side of the rod, the forces applied by the baton to the master carrier tend to cause the master carrier to tilt and bind in the trackway.

Drapery rods whether traverse cord actuated or baton actuated, are needed for use in either left draw or right draw installations, or with the drapery support arm arranged as an underlap arm or as an overlap arm. Various different master carrier constructions have heretofore been made to reduce the number of different master carrier parts that must be made and assembled to accommodate these different installations. Some, for example as shown in U.S. Pat. Nos. 3,342,247; 3,354,498; and 3,736,620, and 4,785,867, require different drapery overlap and underlap arms. U.S. Pat. No. 3,663,988 discloses a master carrier which can be assembled for use in either left or right draw installations and also as either an overlap or underlap arm. However, the master carrier in this patent requires forming and assembling three different pieces.

SUMMARY OF THE INVENTION

It is an object of the present invention to provide a drapery rod master carrier formed in two pieces which can be used for either left or right draw and as either underlap and overlap arms.

Another object of this invention is to provide a drapery rod master carrier in accordance with the foregoing object which is adapted for use in baton draw installations and is so arranged that the baton draw forces are disposed closely adjacent an upright plane through the track of the traverse rod, when the carrier is used in either the right or left draw mode or in the overlap or underlap mode.

Still another object of this invention is to provide a master carrier construction in which two master carriers of like construction can be used on a rod for two-way draw installations, and in which the drapery support arms can be readily adjusted while the master carrier body is on the rod, to adapt the master carrier for either left or right draw and for operation in either the overlap or underlap mode.

Accordingly, the present invention provides a two-piece drapery traverse rod master carrier comprising a carrier body having rod guide means for slidably supporting the carrier body for lengthwise movement along a traverse rod, and a drapery support arm having lead and trail ends and a mounting stem extending laterally from one side of the support arm at a location intermediate the lead and trail ends of the arm. The carrier body has arm guide means located substantially equi-distant from the ends of the carrier body for guidably supporting the mounting stem for horizontal movement in a direction perpendicular to the path of movement of the carrier body when the lead end of the drapery support arm extends from the arm guide means in either two opposed directions generally parallel to the path of movement of the carrier body.

The arm guide means is disposed at the rear side of an upright plane through the rear trackway of the rod and at a level below the traverse rod and substantially equi-distant from the ends of the carrier body, and baton mounting means are provided on the carrier body below the arm guide means and substantially equi-distant from the ends of the carrier body so that the baton draw forces are applied directly to the carrier body independent of the position of the drapery support arm on the body.

The drapery support am has a second stem extending laterally from the one side of the drapery support arm at a location intermediate the support stem and the trail end of the support arm and arranged to engage the carrier body when the support arm generally parallels the path of movement of the carrier, and with the lead end extending in either direction.

Two of the master carriers can advantageously be used in center-draw installations. While a baton can be provided for each master carrier, a baton can be provided for only one of the master carriers and the two master carriers interconnected by the traverse cord for movement in relatively opposite directions in response to movement of one master carrier by the baton. While this latter arrangement increases the number of parts and the cost of assembly somewhat, it is less complicated than drapery rods using traverse rods for moving the master carrier and further avoids the downwardly extending operating cords or a cord loop, as occurs in full traverse cord operations.

BRIEF DESCRIPTION OF THE DRAWINGS

FIG. 1 is a perspective view of a one-way draw traverse rod installation embodying the master carrier of the present invention;

FIG. 2 is a fragmentary perspective view, with parts broken away and illustrating a two-way traverse rod installation;

FIG. 3 is an exploded perspective view of the master carrier of the present invention;

DETAILED DESCRIPTION

Figure 4:
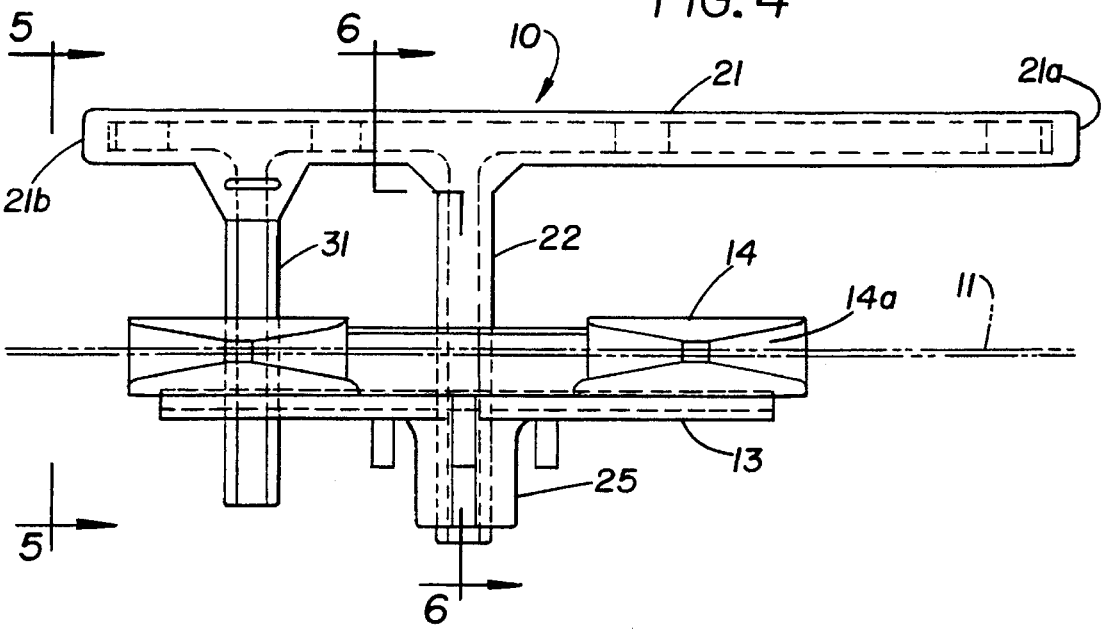
FIG. 4 is a top plan view of the master carrier.

The master carrier 10 of the present invention is illustrated in FIG. 1 is mounted on a traverse rod 11 in a one-way draw installation and a pair of master carriers 10 are shown in FIG. 2 mounted on a traverse rod 11 in a two-way draw installation. The master carrier 10 herein shown is arranged for use on a traverse rod 11 of the type having a slot 11*a* defining a trackway at the rear side of the rod. The master carrier 10 in general includes a slide body 13 conveniently formed of a suitable rigid plastic material and having rod guides 14 adjacent opposite ends with upper and lower grooves 14*a*, 14*b* for slidably receiving the edges of the rod at opposite sides of the slot 11*a*.

Figure 5:
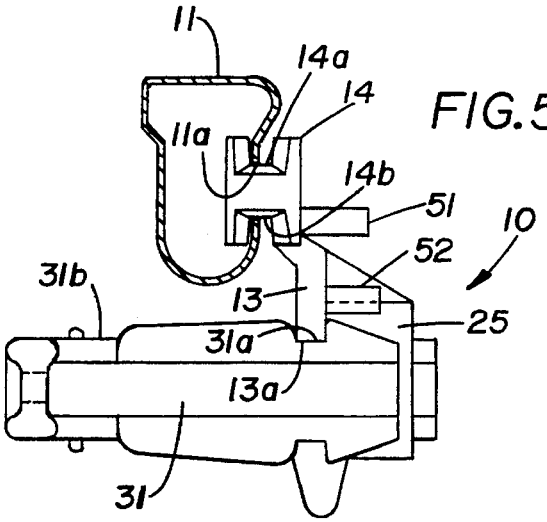
FIG. 5 is a end view taken on the plane 5—5 of FIG. 4.
Figure 6:
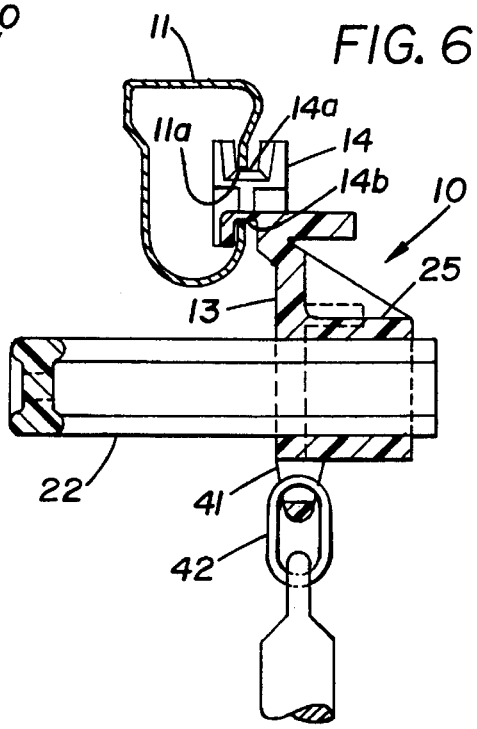
FIG. 6 is a sectional view taken on the plane 6—6 of FIG. 4.

An elongated drapery support arm 21 having lead and trail ends 21*a*, 21*b*, and a plurality of drapery hook receiving openings 21*c*, is mounted on the slide body in a manner to enable use of the support arm for left draw and right draw installations and also for use in an overlap mode or underlap mode. The drapery support arm has a mounting stem 22 extending laterally from one side thereof at a location intermediate the lead and trail ends 21*a*, 21*b* and preferably spaced somewhat farther from the lead end than from the trail end. The carrier body has arm guide means 25 arranged to guidably support the stem 22 for horizontal movement in a direction perpendicular to the path of movement of the carrier body, for adjusting the lateral spacing of the drapery support arm relative to the carrier body. As best shown in FIGS. 5 and 6 the arm guide means 25 is disposed at a rear side of an upright plane through the rear slot or trackway 11*a*, that is at a rear side of the plane through the upper and lower grooves 14*a*, 14*b* of the rod guides 14. The arm guide means is disposed at a level below the underside of the traverse rod, and substantiality equi-distant from the ends of the slide body. The mounting stem 22 preferably has a non-circular cross-sectional configuration and the arm guide means defines a passage 25*a* that slidably receives the stem 22 in either of two oppositely directed positions as shown in FIG. 2 in which the arm 21 extends generally parallel to the path of movement of the carrier body on the rod.

Figure 9:
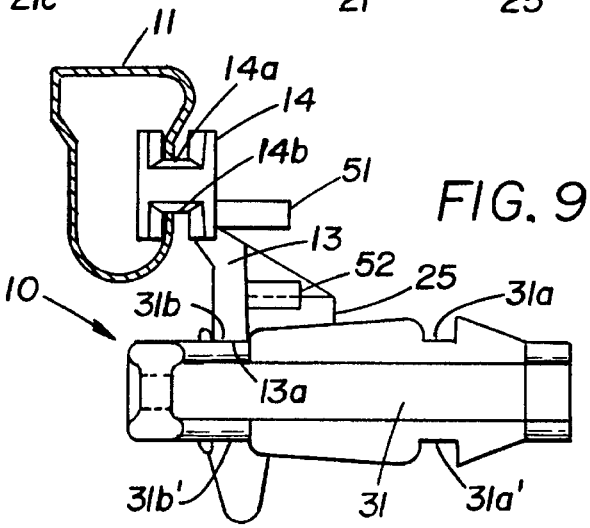
FIG. 9 is an end view illustrating the drapery support arm in an underlap condition.

A second stem 31 is advantageously provided on the drapery support arm and extends laterally from a rear side of the support arm generally parallel to the stem 22, at a location intermediate the stem 22 and the trail end 21*b* of the support arm. The stem 31 is arranged to engage a downwardly facing ledge 13*a* ledge at the underside of the carrier body 13 when the lead end 21*a* of the arm extends in one direction relative to the carrier body as shown in FIGS. 3, 5 and 9, and the arm 31 is arranged to engage a downwardly facing ledge 13*b* (FIG. 3) when the lead end of 21*a* of the drapery support arm extends in a direction opposite that shown in FIG. 3. The stem 31 is also arranged to releasably hold the drapery support arm in different lateral positions relative to the slide body. As best shown in FIGS. 3 and 9, a side of the stem 31 that faces upwardly when the drapery support arm is in the position shown in FIGS. 3 and 5, is provided with a first notch 31*a* arranged to receive the downwardly facing ledge 13*a* on the carrier body, to retain the drapery support arm in an overlap position, and a second notch 31*b* arranged to receive the ledge 31*a* when the drapery support arm is an overlap position as shown in FIG. 9. Similarly, the other side of the stem 31 is formed with notches 31*a*' and 31*b*' to receive the ledge 13*b* on the carrier body, when the drapery support arm extends in a direction opposite that shown in FIG. 3. Thus, notch 31*a*' retains the drapery support arm in an overlap position and notch 31*b*' retains the drapery support arm in an underlap position. Obviously, additional notches can be provided if desired to support the drapery support arm in other lateral positions relatively to the slide body.

Means are provided for attaching a baton to the master carrier at a location adjacent an upright plane through the track receiving grooves 14*a*, 14*b* in the rod guides 14, and substantially equi-distant from opposite ends of the carrier body. The baton is preferably mounted on the underside of the rod guide and, in the embodiment illustrated, the baton mount includes an eye 41 formed on the underside of the arm guide 25 adjacent the forward end of the latter and a baton B is swivelly attached to the eye 41 as by a ring 42 (see FIG. 6). With this arrangement, the draw forces: exerted by the baton on the master carrier are located closely adjacent a plane through the track guides 14 and are centered with respect to the lengthwise dimension of the carrier body, to minimize the tendency of the baton forces to cause tilting or binding of the master carrier on the trackway.

Figure 7:
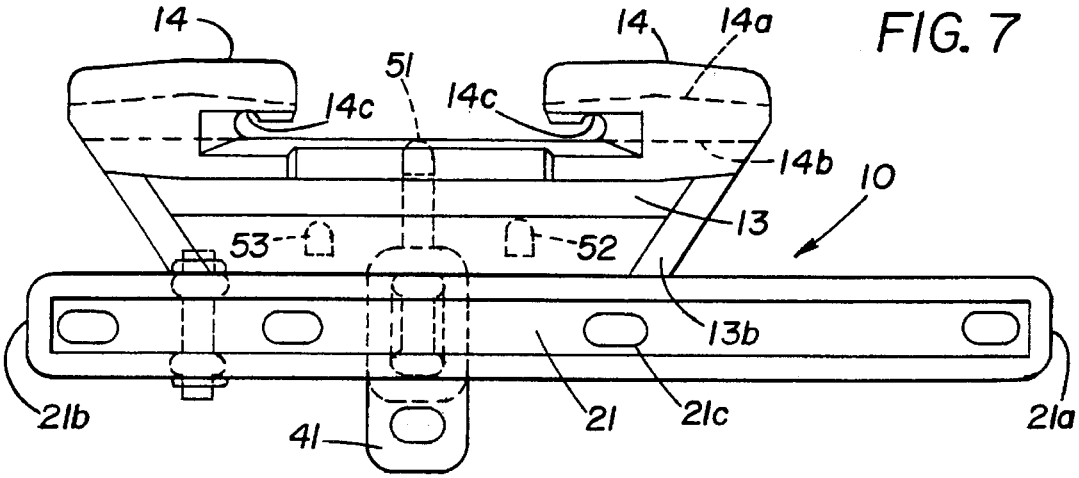
FIG. 7 is a front view of the master carrier.
Figure 8:
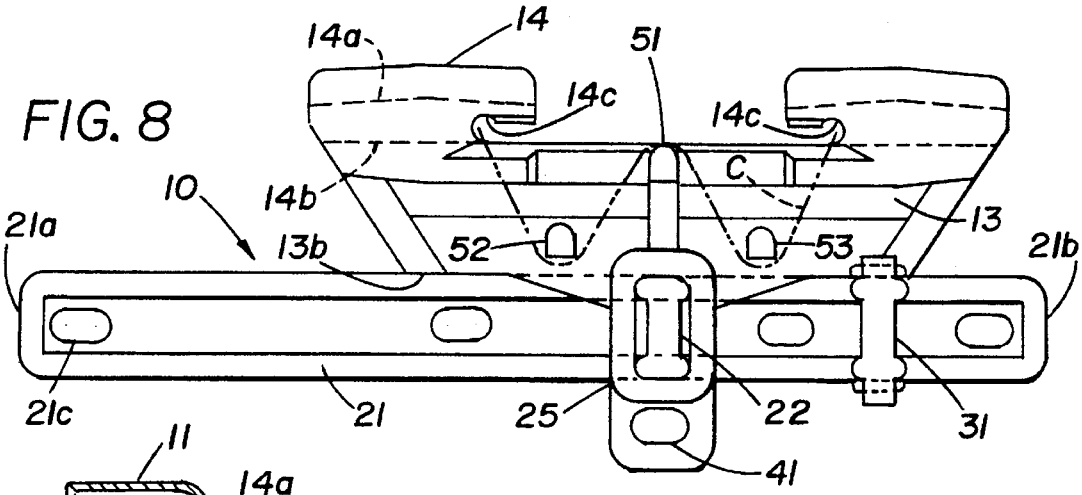
FIG. 8 is a rear view of the master carrier.

The master carrier can be operated by the baton B in either right draw or left draw installations and with the drapery support arm in either the overlap or underlap position. Further, two master carriers of like construction can be used in center or two-way draw installations using batons to operate each master carrier. However, the master carriers are also advantageously arranged so as to enable connection to a traverse cord for movement along the rod in relatively opposite directions. As best shown in FIGS. 7 and 8, the rod guides 14 are formed with lateral cord notches 14*c* at a location intermediate the grooves 14*a* and 14*b* to allow passage of a portion of a traverse cord from the inside of the rod 11 to a cord lock on the master carrier body at the rear side of the rod. In the embodiment illustrated, three rearwardly extending projections 51, 52 and 53 are provided at the rear side of the rod and are disposed at different levels and laterally spaced apart so that a portion of a traverse cord C can be passed from the notch 14*c* in one rod guide 14 under one projection 52 over a second projection 51 and under a third projection 53 back to a notch 14*c* in the other cord guide as shown in phantom lines in FIG. 8. This arrangement is such as to inhibit slippage of the master carrier relative to the traverse cord when the traverse cord is taut.

Figure 10:
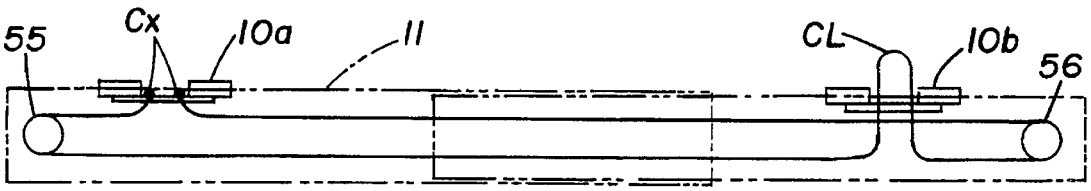
FIG. 10 is a schematic view illustrating a pair of master carriers interconnected for a center draw installation.

A traverse cord arrangement for interconnecting two master carriers for operation in opposite directions, is schematically illustrated in FIG. 10. The rod 11 is of a telescopically adjustable type and has pulleys 55, 56 rotatably supported, conveniently on end caps at the distal ends of the rod sections. Two of the master carriers 10*a* and 10*b*, and pulleys 55 56 can be pre-assembled on the rod 11 together with a length of cord C slightly greater than twice the spacing between the pulleys 55 and 56 when the rod is in a fully extended position. As shown in FIG. 10, the traverse cord C is looped intermediate its ends over the pulleys 55 and 56 and the ends of the cord are drawn through the notches 14*c* in one carrier 10*a* and knotted or otherwise anchored to that carrier as shown at CX. A run of the cord that extends between the pulleys 55 and 56 is drawn out of the rod through the space between the cord notches 14 on the other master carrier 10*b*. The rod can be assembled and shipped with the rod in a fully collapsed or telescoped length and with one master carrier having a hank or loop of cord CL extending outwardly at the rear. The user can adjust the rod to the desired length and, as this occurs, the cord will be pulled through the carrier slots. Once the size is determined, the user can tie one knot at the end of each tailing cord projecting from the rear of tile carrier and cut off excess cord. Once the assembly is installed, the user can switch the rod from left to a right draw by switching the baton from one carrier to the other and by changing the position of the drapery support arms for underlap or overlap.

The embodiments of the invention in which an exclusive property or privilege is claimed are defined as follows:

1. A drapery rod and master carrier combination comprising: a carrier body having first and second ends and rod guide means for slidably supporting the carrier body for movement along a path lengthwise of the traverse rod, an elongated drapery support arm having lead and trail ends, a first stem extending laterally from one side of the support arm at a location intermediate the lead and trail ends and a second stem extending laterally from said one side of the drapery support arm at a location intermediate the first stem and the trail end of the support arm, the lead end of the drapery support arm being spaced from the first stem a distance greater that the spacing of the trail end of the drapery support arm from the first stem, the carrier body having arm guide means guidably supporting the first stem for horizontal movement relative to the carrier body in a direction perpendicular to the path of movement of the carrier body for adjusting the drapery support arm laterally relative to the carrier body between a first lateral position and at least a second lateral position, and means on the second stem engageable with the carrier body (a) at a first location intermediate the guide means and the second end of the carrier body when the lead end of the drapery support arm extends from the arm guide means in one direction generally parallel to the path of movement of the carrier body and (b) at a second location intermediate the guide means and the first end of the carrier body when the lead end of the drapery support arm extends from the arm guide means in a direction opposite said one direction generally parallel to the path of movement of the carrier body.

2. A drapery traverse rod and master carrier according to claim 1 wherein the arm guide means is located substantially equi-distant from the first and second ends of the carrier body.

3. A drapery traverse rod and master carrier according to claim 2 including baton mounting means on the carrier body below the arm guide means, and baton means attached to said baton mounting means.

4. A drapery traverse rod and master carrier according to claim 1 including baton mounting means on the carrier body at a location substantially equi-distant from the first and second ends of the carrier body.

5. A drapery traverse rod and master carrier according to claim 1 wherein the second stem has means selectively engageable with the carrier body for retaining the drapery support arm in said first and second lateral positions.

6. A drapery traverse rod and master carrier combination comprising: A carrier body having first and second ends and rod guide means for slidably supporting the carrier body for horizontal movement along a path lengthwise of the traverse rod, an elongated drapery support arm having lead and trail ends, a first stem extending laterally from one side of the support arm at a location intermediate the lead and trail ends and a second stem extending laterally from said one side of the drapery support arm at a location intermediate the first stem and the trail end of the support arm, the lead end of the drapery support arm being spaced from the first stem a distance greater than the spacing of the trail end of the drapery support arm from the first stem, the carrier body having arm guide means located substantially equi-distant from the first and second ends of the carrier body for guidably supporting the first stem for horizontal movement relative to the carrier body in a direction perpendicular to the path of movement of the carrier body for adjusting the drapery support arm relative to the carrier body between a first lateral position and at least a second lateral position, and means on the second stem engageable with the carrier body (a) at a first location intermediate the guide means and the second end of the carrier body when the lead end of the drapery support arm extends from the arm guide means in one direction generally parallel to the path of movement of the carrier body and (b) at a second location intermediate the guide means and the first end of the carrier body when the lead end of the drapery support arm extends from the arm guide means in a direction opposite said one direction generally parallel to the path of movement of the carrier body, baton mounting means on the carrier body at a location substantially equi-distant from the first and second ends of the carrier body and baton means attached to said baton mounting means.

7. A drapery traverse rod and master carrier according to claim 6 wherein the second stem has means selectively engageable with the carrier body for retaining the drapery support arm in said first and second lateral positions.

8. In combination, a traverse rod having a lengthwise extending rear trackway at a rear side thereof, a master carrier comprising a carrier body having first and second ends and rod guide means slidably supporting the carrier body on the trackway for moment along a path lengthwise of the traverse rod, elongated drapery support arm having lead and trail ends, a first stem extending laterally from one side of the support arm at a location intermediate the lead and trail ends, the lead end of the drapery support arm being spaced from the first stem a distance greater than the spacing of the trail end of the drapery support arm from the first stem, the carrier body having guide means disposed at a rear side of an upright plane through said rear trackway and at a level below the traverse rod for guidably supporting said first stem for horizontal movement below the rod in a direction perpendicular to the path of movement of the carrier body to adjust the drapery support arm relative to the carrier body between a first lateral position and at least a second lateral position, said arm guide means being located substantially equi-distant from the first and second ends of the carrier body, baton mounting means on the carrier body below the arm guide means and substantially equi-distant from the first and second ends of the carrier body, and baton means attached to said baton mounting means.

9. The combination of claim 8 wherein the drapery support arm has a second stem extending laterally from said one side of the drapery support arm at a location intermediate the support stem and the trail end of the support arm, means on said second stem engageable with the carrier body (a) at a first location intermediate the guide means and the second end of the carrier body when the lead end of the support arm extends in one direction generally parallel to the path of movement of the carrier body and, (b) at a second location intermediate the guide means and the first end of the carrier body when the lead end of the drapery support arm extends generally parallel to the path of movement of the carrier body in a direction opposite said one direction.

10. The combination of claim 9 wherein the traverse rod comprises at least two telescopically adjustable sections.

11. In combination, traverse rod having at least two telescopically adjustable sections and a lengthwise extending rear trackway at the rear side of each section, first and second master carriers of like construction and each comprising: a carrier body having first and second ends and rod guide means slidably supporting the carrier body on the trackway for movement along a path lengthwise of the traverse rod, an elongated drapery support arm having lead and trail ends, a first stem extending laterally from on side of the support arm at a location intermediated the lead and trail ends, the lead end of the drapery support arm being spaced from the first stem a distance greater than the spacing of the trail end of the drapery support arm form the first stem, the carrier body having arm guide means disposed at a rear side of an upright plane through said rear trackway and at a level below the traverse rod for guidably supporting said first stem for horizontal movement below the rod in a direction perpendicular the path of movement of the carrier body to adjust the drapery support arm relative to the carrier body between a first lateral position and at least a second lateral position, said arm guide means being located substantially equi-distant from the first and second ends of the carrier body, baton mounting means on the carrier body below the arm guide means and substantially equi-distant from the first and second ends of the carrier body, and at least one baton means adapted for attachment to the baton mounting means on either one of the master carriers.

12. The combination of claim 11 wherein the traverse rod sections each have a pulley in distal ends thereof, and a traverse cord in the traverse rod entrained over the pulleys and connected to the first and second master carriers operative when one master carrier is moved in one direction for moving the other master carrier in the opposite direction.

13. The combination of claim 11 wherein each drapery support arm has a second stem extending laterally from said one side of the drapery support arm at a location intermediate the first stem and trail end of the support arm, means on said second stem engageable with the carrier body (a) at a first location intermediate the guide means and the second end of the carrier body when the lead end of the support arm extends in one direction generally parallel to the path of movement of the carrier body and, (b) at a second location intermediate the guide means and the first end of the carrier body when the lead end of the drapery support arm extends generally parallel to the path of movement of the carrier body in a direction opposite said one direction.

14. The combination of claim 13 wherein the traverse rod sections each have a pulley in distal ends thereof, and a traverse cord in the traverse rod entrained over the pulleys and connected to the first and second master carriers operative when one master carrier is moved in one direction for moving the other master carrier in the opposite direction.

* * * * *